United States Patent [19]

Müller et al.

[11] 3,952,868

[45] Apr. 27, 1976

[54] CIGARETTE PACKET OF LAMINATED SHEETING AND METHOD FOR THE PRODUCTION THEREOF

[75] Inventors: Dietrich Müller; Hans-Jürgen Blichenberg, both of Hamburg; Dieter Schmidt, Halstenbek; Heinz Focke; Kurt Liedtke, both of Verden, all of Germany

[73] Assignee: Focke & Pfuhl, Verden, Aller, Germany

[22] Filed: June 20, 1974

[21] Appl. No.: 481,418

[30] Foreign Application Priority Data

June 20, 1973 Germany ..... 2331335

[52] U.S. Cl. ..... 206/273; 156/272; 206/274; 220/DIG. 31; 229/87 C

[51] Int. Cl.[2] ..... B65D 65/02; B65D 75/20; B65D 75/26; B65D 85/10

[58] Field of Search ..... 206/271, 273–275; 229/37 R, 38, 40, 44, 57, 60, 62, 87 R, 87 C; 220/DIG. 31; 156/73.1, 272

[56] References Cited

UNITED STATES PATENTS

| | | | |
|---|---|---|---|
| 1,702,325 | 2/1929 | Van Sickels | 206/274 X |
| 1,907,067 | 5/1933 | Hartmann | 206/274 X |
| 2,480,501 | 8/1949 | Moore | 220/DIG. 31 |
| 3,333,683 | 8/1967 | Scharre | 206/245 |
| 3,651,615 | 3/1972 | Bohner et al. | 220/DIG. 31 |

FOREIGN PATENTS OR APPLICATIONS

| | | | |
|---|---|---|---|
| 728,324 | 4/1955 | United Kingdom | 229/87 C |
| 699,073 | 10/1953 | United Kingdom | 229/38 |
| 375,049 | 6/1932 | United Kingdom | 229/87 C |

*Primary Examiner*—Steven E. Lipman
*Attorney, Agent, or Firm*—Sughrue, Rothwell, Mion, Zinn & Macpeak

[57] ABSTRACT

A cigarette packet of a laminated sheeting is disclosed which comprises an outer, thermally-bonded weldable layer, and wherein the end flaps of the blank forming the packet are joined to each other and project beyond the end sides. The end flaps are folded in such a way that an inner, longitudinal end flap bears on the packet contents, and two side end flaps are folded on this longitudinal end flap, and a second outer longitudinal end flap on the side of the first inner longitudinal end flap. The particular improvement disclosed utilizes a laminated foil having on both sides an outer thermally bondable layer, which extends over the entire end face of the layer and along an edge turned toward the edge of the inner longitudinal end flap. The side end flaps are joined at their diagonals along a welding strip which extends on a diagonal fold line adjoining the weld strip which extends along the length of the end face.

4 Claims, 11 Drawing Figures

19
20
21
24
14
31
21
19
24
20

24
32
33
21
19
24
20
31

24
32
33
21
19
24
20
31
36

CIGARETTE PACKET OF LAMINATED SHEETING AND METHOD FOR THE PRODUCTION THEREOF

The invention relates to a packet comprising a foldable blank, more particularly of laminated sheeting, to accommodate rod-shaped objects, more particularly cigarettes, the blank surrounding the packet contents in tubular manner and end flaps, which are joined to each other and project beyond the end sides, being so folded that an inner longitudinal end flap bears on the packet contents, two side end flaps being folded upon the said longitudinal end flap and the second, outer longitudinal end flap being folded upon the side end flaps and upon the first inner longitudinal end flap.

To the extent to which they comprise so-called soft packets known conventional cigarette packets in practice comprise a plurality of blanks of different materials which are folded in successive folding operations into a packet. Three different materials or blanks are predominantly used, namely a tin foil blank, a paper blank and an outer cellophane covering. It is obvious that the production of such a packet is awkward both in terms of the material as well as in terms of the amount of labour.

The invention relates to a packet which is to comprise a single blank more particularly of so-called laminated sheeting. Laminated sheeting is basically already known. It comprises a plurality of plies which are joined to each other. According to one embodiment of such laminated sheeting five plies are provided, namely three polyethylene sheeting plies, an aluminium foil ply and a paper ply. The sequence of plies is such that a polyethylene sheeting ply is always disposed on the outside. This is followed by the paper ply or by the aluminium foil ply. The two last mentioned are again separated from each other by an internally disposed polyethylene sheeting ply.

The problem of using such laminated sheeting for sealed packets, more particularly cigarette packets is due to the need for providing a packet shape which is on the one hand adapted to the characteristics of the laminated sheeting and on the other hand to the requirements made by a cigarette packet.

The invention is based on the knowledge that a packet, in which the end flaps, produced by the tubular blank surrounding the packet contents, are folded in a particular manner, is especially suitable when using laminated sheeting. An inner longitudinal end flap is first folded against the end face of the packet followed by folding of the two side end flaps and finally by folding of the outer longitudinal end flaps against the aforementioned end face.

The invention relates to the closure for such a packet. The closure must be constructed so as to permit mechanised production with a high machine output rate while at the same time ensuring the sealing tightness for the closure demanded for cigarettes and similar packaged goods.

To solve this problem the packet according to the invention is characterised by the provision of a closure which extends over the width of the packet and joins adjacently disposed end flaps by welding or adhesion but merely in the half of the packet end face which is nearest to the free edge of the outer longitudinal end flap. Advantageously a welding or adhesive strip which extends over the width of the packet and contacts the free edge of the outer longitudinal end flap is provided on the top of the inner longitudinal end flap on the side which faces away from the free edge of the said longitudinal end flap. On the one hand this adequately locates the outer longitudinal end flap and on the other hand ensures the provision of a closure which extends over the width of the packet. Welding or adhesive strips are additionally provided in the region of the side end flaps and in such a way that at least the triangular zones which bear upon each other through folding and are associated with the side end flaps, are joined to each other. This provides additional stability. Moreover, interconnection of the triangular zones of the side end flaps completes the closure in such a way to be closed all round in tightly sealed manner. The entire closure is situated in one longitudinal half of the end face.

There is the additional advantage that all the previously mentioned welding and adhesion strips are applied to surfaces which can be activated by a common energy source, more particularly by a common radiation apparatus, when the packet is partially closed. The previously mentioned welding or adhesion strips are situated in regions of the packet where folding edges or superjacent plies of the sheeting provide increased stiffness to the required contact pressure when the packet is closed. The invention therefore for the first time enables such an adhesion or welding closure to be achieved by pressing plies, which are to be joined to each other, upon the packet contents. Surprisingly, the said contents are stressed only within tolerable limits because the previously mentioned increased stiffness of the packet is provided in the regions of the adhesion or welded joints.

Further features of the invention relate to modifications of the closure at the bottom or top wall of the packet. The welding or adhesion joint used to this end can be produced in different manner. The join is advantageously achieved by plasticizing and pressing together of the outer plastics sheeting in the case of laminated sheeting with external thermoplastics plies. To this end the welding strips are appropriately marked on the packet blank as dark strips which absorb light rays. It is however also possible to apply separate adhesion strips which are activated by suitable energy sources.

Embodiments of the invention are explained hereinbelow by reference to the accompanying drawings in which:

BRIEF DESCRIPTIONS OF THE DRAWINGS

FIG. 1 is a blank as an exemplified embodiment of a packet according to the invention, FIGS. 2 to 6 show different folding steps in the production and closing of the packet according to FIG. 1 as a perspective view, FIGS. 7 to 9 are side views of the illustrations in FIGS. 2, 4 and 5, shown with a light beam apparatus in FIG. 9, FIG. 10 is a blank of another embodiment of the invention, FIG. 11 is a blank of a further embodiment of the invention.

DESCRIPTION OF THE PREFERRED EMBODIMENT

The invention is primarily concerned with the processing of laminated sheeting for the production of packets, more particularly cigarette packets. Laminated sheeting of this kind more particularly comprises three plies of polyethylene which are disposed on the interior and exterior with an intermediately disposed aluminium foil and a paper ply. The last mentioned paper ply is printed in conventional manner. The invention is concerned particularly with the construction of the packet closure for a specific packet construction.

Figure 1:
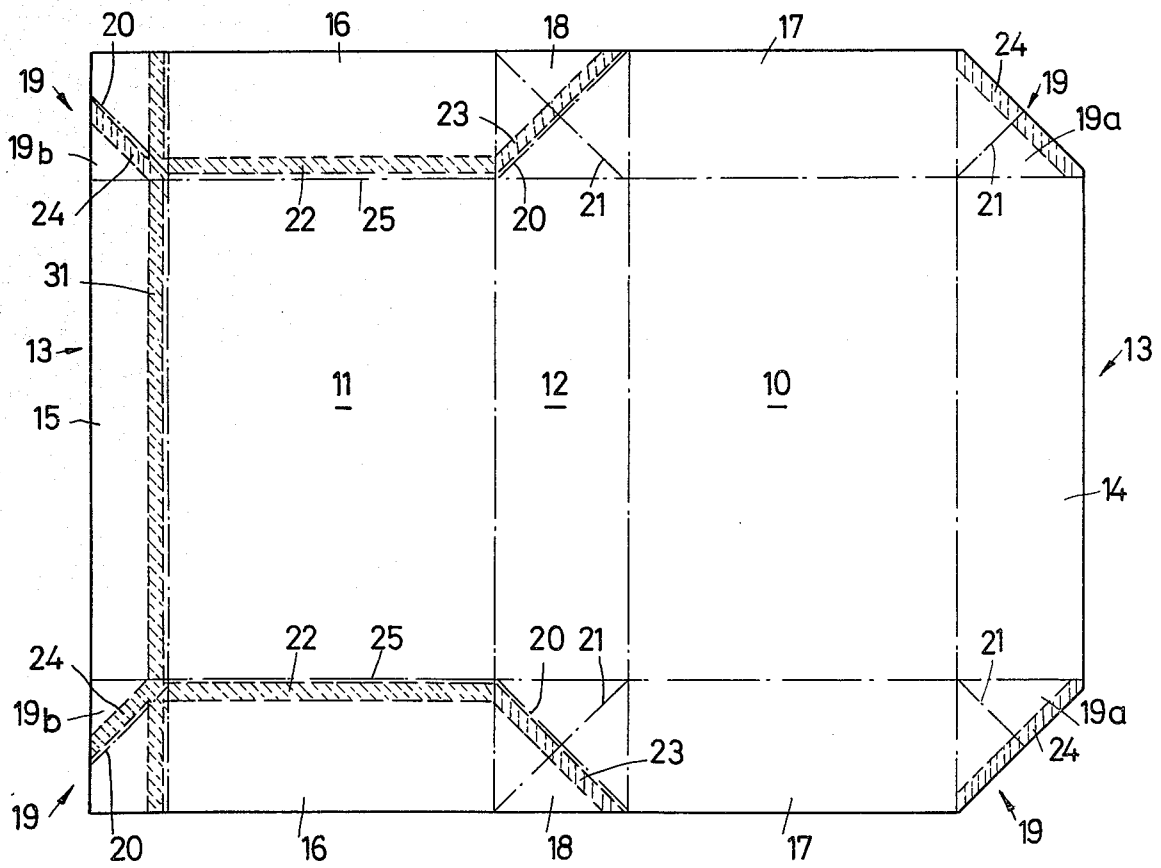

FIG. 1 shows a blank for a cigarette packet in the developed state. The blank is sub-divided into individual zones by precreased folding lines. This produces the front wall 10, the rear wall 11 and side walls 12 or 13. The bottom and lid of the packet are folded in a special known manner as will be described in detail hereinbelow. The side wall 13 is produced by overlapping and joining of two side flaps 14 and 15 which adjoin the front wall 10 or the rear wall 11.

The end sides (bottom and lid) of the packet are formed by end flaps which are folded against the packet contents. The said flaps are longitudinal end flaps 16 and 17 in the region of the front wall 10 and the rear wall 11 and side end flaps 18 and 19 in the region of the side walls 12 and 13. The side end flaps 19 comprise part flaps 19*a* and 19*b* which are partially overlapped and are joined to each other in the same way as the side flaps 14 and 15 when the tubular sheath is formed. To join the side flaps 14 and 15 to each other the last mentioned side flaps is provided with a welding or adhesion strip 31 which is continuous over the length of the blank, therefore also over the part flaps 19*b*. The said welding or adhesion strip 31 is disposed on the side nearest to the adjacent zone of the rear wall 11 and therefore contacts the free edge of the side flap 14. In the embodiment illustrated in FIG. 1 the part flap 19*a* has been reduced by the removal of a triangular gusset.

The side end flaps 18 and 19 are premarked by intersecting and diagonally extending folding lines 20 and 21. Intersecting folds are formed in the region of the said folding lines.

Figure 2:
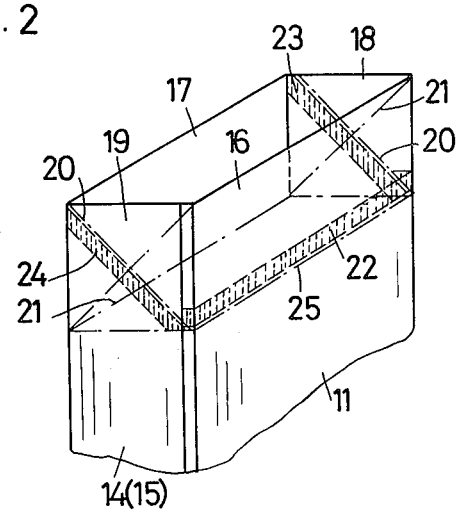
Figure 3:
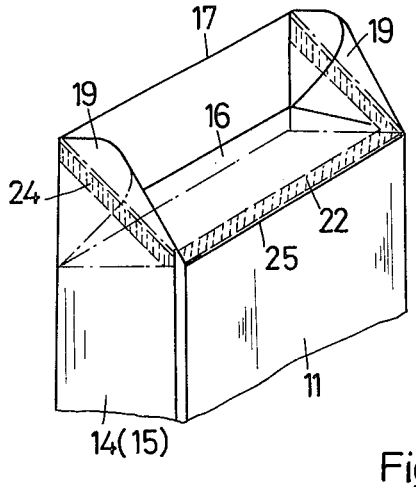
Figure 4:
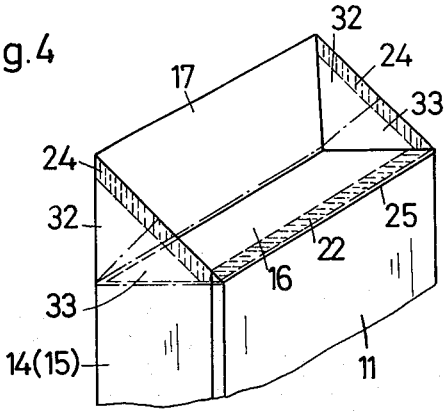
Figure 5:
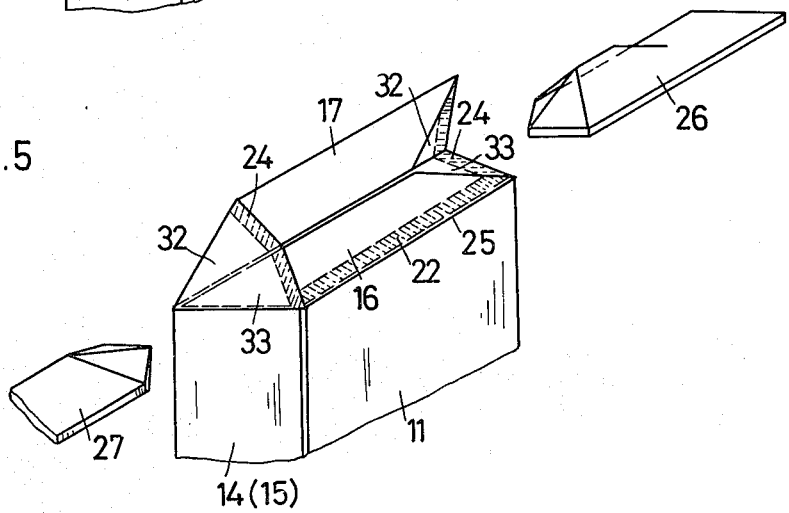

FIGS. 2 to 6 show the folding operation for the lid closure of a packet in diagrammatic and perspective view, the part flap 19b in this case being complete. Individual phases of the folding operation, namely those corresponding to FIGS. 2, 4 and 5, are shown as a side view in FIGS. 7 – 9.

Figures 7, 8, 9:
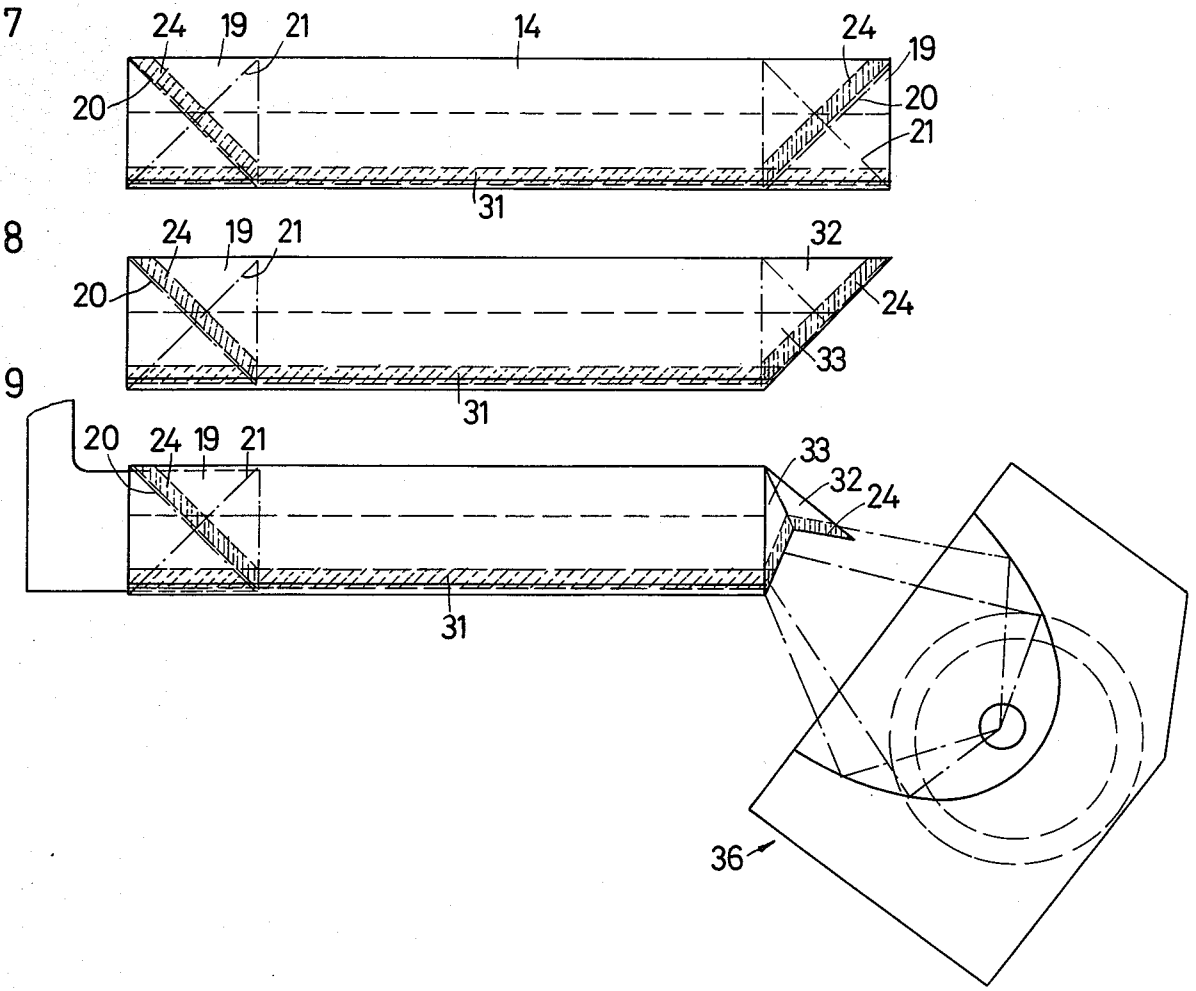

A first longitudinal end flap 16 of the end flap (FIGS. 2 and 7) which project beyond the packet content after the tubular packet is formed, is first folded against the packet contents (FIG. 3). Joining to the side end flaps 18 and 19 causes these to be partially folded along the diagonally extending crease line 20. The side end flaps 18 and 19 therefore assume a double ply configuration and a triangular shape (FIGS. 4 and 8). The triangular side end flaps 18 and 19 are then folded inwardly against the top of the inner longitudinal end flap 16 by side folders 26 and 27 which are inserted from the side. Folding of the outer longitudinal end flap 17 is initiated simultaneously with the aforementioned inward folding operation, namely into a position according to FIGS. 5 or 9. The side end flaps 18 and 19 associated with the two longitudinal end flaps 16 and 17 will then function as hinges.

Owing to the particular construction of the closure it is possible for the packet, more particularly the packet comprising laminated sheeting, to be closed in sealing tight manner without any additional special closing tabs, adhesively attached closing strips or the like. This is made possible by the developed arrangement and shape of the welding or adhesion strips. When using laminated sheeting with externally disposed plastics sheeting for example polyethylene sheeting the closure is advantageously formed by thermal plasticizing of the sheeting itself in the zone of the marked welding strips. The outer plastics sheeting of the laminated sheeting are thus directly joined to each other. To this end the packet blank is provided with dark, light absorbing strips which mark the welding strips and in whose zone plasticizing takes place by a light emission apparatus 36 or the like.

The preferred embodiment of FIGS. 1 to 9 is provided with a welding strip 22 which extends along the folding edge 25 which adjoins the rear wall 11 of the packet. The said welding strip 22 extends over the entire width of the packet and therefore over the entire width of the longitudinal end flap 16 as far as the adjoining side end flaps 18 and 19. Welding strips 23 and 24 adjoin the welding strip 22 in the region of the side end flaps 18 and 19. Each of the said welding strips passes on one side of the diagonally extending folding line 20 of the side end flaps 18 and 19 preferably over the entire length of the said folding lines. The welding strips 23 and 24 are arranged on one side of the folding lines 20 so that when the packet is in the folded state the triangular zones 32 and 33, which are produced during inward folding in accordance with FIGS. 5 and 9 and are associated with the side end flaps 18 and 19, can be joined to each other along their free superjacently disposed edges.

Figure 6:
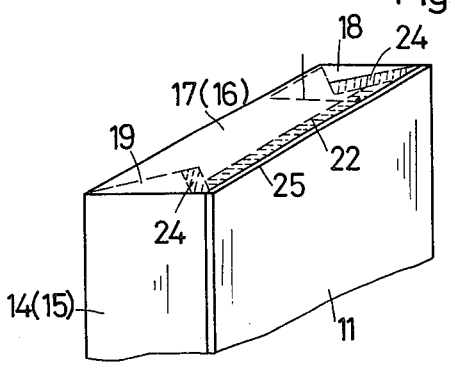

The shape of the closure which is thus formed can be seen particularly clearly by reference to FIG. 6. The welding strips 22, 23 and 24 which comprise the closure are disposed exclusively in one half of the end face of the packet. Furthermore, the closure is completely sealing tight. The top longitudinal end flap 17 is also located in a sealed arrangement by means of welding strips 24.

Advantageously the welding strips 22, 23 and 24 are situated in regions of the packet which have increased resistance against contact pressure when the closure is produced. The welding strip 22 passes along the edge 25 formed between the rear wall 11 and the inner longitudinal end flap 16. The welding strips 23 and 24 extend in the region of the multi-ply fold of the side end flaps 18 and 19.

A special rationalised and therefore efficient procedure is adopted in the production of the closure in accordance with FIGS. 5 and 9. The side inward folders 26 and 27 are constructed so that the packet is not completely moved into its final position when the side end flaps 18 and 19 are inwardly folded. This is achieved by appropriate construction of the side inward folders 26 and 27. The packet therefore assumes a partially closed position according to FIGS. 5 and 9. In this position all welding strips 22, 23 and 24 are exposed so that a common light beam apparatus 36 which is positioned at an angle is able to simultaneously activate the said welding strips 22, 23 and 24 (FIG. 9). Thereafter a suitable tool merely presses the outer longitudinal end flap 17 against the end face of the packet, the side end flaps 18 and 19 being automatically inwardly folded between the two longitudinal end flaps 16 and 17.

The closure which has been prepared by a single activating process can be so arranged, according to a modification, that a continuous separate welding strip (not shown) of thermoplastic material is inserted into the packet after prefolding in accordance with FIGS. 5 and 9 in such a way that the free half of the end face of the packet is covered between the two longitudinal end flaps 16 and 17. This separate welding strip is then activated. A simple and absolutely sealing tight closure is produced after the longitudinal end flap 17 with the side end flaps 18 and 19 is pressed against the end face.

Figure 10:
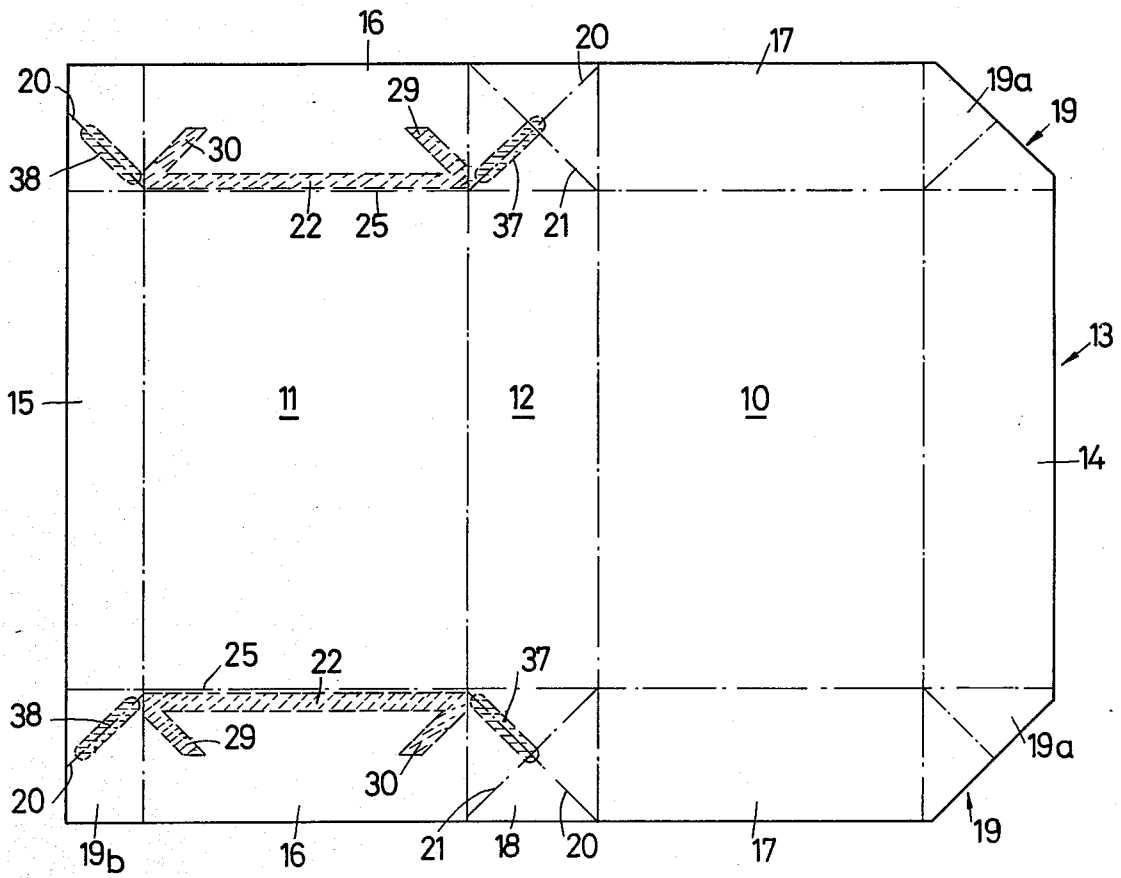

A welding strip 22 is provided along the folding edge 25 in the embodiment according to FIG. 10 in the same way as for the embodiment illustrated in FIGS. 1 to 9. A special step is taken in the region of the side end flaps 18 and 19. The laminated sheeting comprising the blank is provided with partial apertures 37 and 38 at marked positions, namely along the folding lines 20 or a part region thereof, preferably beyond the intersection of folding lines 20 and 21. The partial apertures 37 and 38 are formed by punch perforations of the non-weldable plies, more particularly the aluminium ply and the paper ply, in the aforementioned regions when the laminated sheeting is produced while the weldable polyethylene sheeting is continuous. This produces transparent or translucent regions which are rendered particularly weldable by virtue of the direct superjacent configuration of a plurality of polyethylene sheets. In the embodiment according to FIG. 10 the partial perforations 37 and 38 are situated in places in which edges of the side end flaps 18 and 19 bear upon each other on the inside or on the inner longitudinal end flap 17 of the finished packet. To this end members 29 and 30 which extend at the same angle as the folding lines 20 or as the partial perforations 37 and 38 adjoin the welding strip 22 on the longitudinal end flaps 16 and 17. In the folded state the partial perforations will therefore be disposed on the members 29 and 30 so that the triangular zones 32 and 33 of the side end flaps 18 and 19 are intermittently joined to each other and to the longitudinal end flap 16 when the polyethylene sheeting is activated in the region of the welding strip 22.

Figure 11:
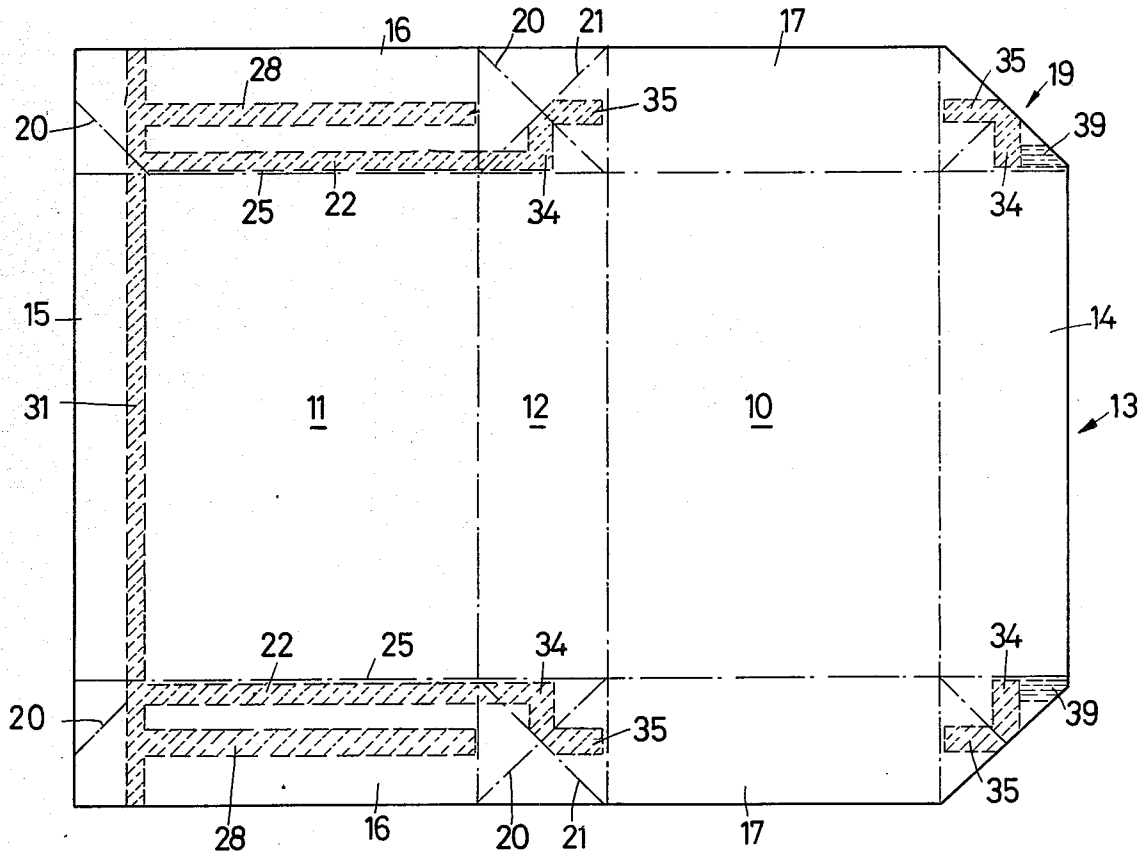

In addition to the welding strip 22 the packet according to a blank as illustrated in FIG. 11 is provided with a further second welding strip 28 which extends approximately in the middle of the end face. The last mentioned welding strip can be applied in special cases in which a particularly strong closure is desired.

The welding strip 28 extends over the entire length of the longitudinal end flap 16, which is initially folded against the packet contents, or as far as the welding strip 31 in the region of the side flap 15. The configuration of the welding strips on the side end flaps 18 and 19 also differs from the embodiment according to FIG. 1. Each side end flap 18 or the partial flap 19*a* is provided with welding strips or adhesion strips 34 and 35 which are oriented at right angles to each other. The said strips converge approximately in the region of the intersection of the folding lines 20 and 21 and are orientated at an angle of 45° thereto, and are therefore positioned perpendicularly or parallel to the welding strip 22. The welding strip 22 is extended into the region of the side end flap 18 and adjoins the free end of the welding strip or adhesion strip 34. By analogy a welding piece or adhesion piece 39 is provided in the region of the part flap 19a and adjoins the associated welding strips or adhesion strips 34 to complete the welding strip or adhesion strip 22 when the sleeve is closed in tubular form. In this embodiment which is folded in the same way as described by reference to FIGS. 2 to 9 the packet is provided with a sealing tight closure namely by the welding strip for the lid and bottom in the region of the end face half nearest to the free edge of the top longitudinal end flap 17. In accordance with the desired fundamental aim the welding strips in this case can also be activated by a common light radiation apparatus when the packet is partially closed (FIGS. 5 and 9).

Alternatively the packet according to FIG. 11 can be constructed so that the welding strip 28 is provided on the bottom of the top or outer longitudinal end flap 17. To activate the welding strip which forms the closure the free half of the outer longitudinal end flap 17 which projects at an angle is outwardly folded, while the packet is partially open in the sense of FIGS. 5 and 9, in such a way that the side of the longitudinal end flap 17 which faces inwardly in the finished packet is positioned outwardly or is nearest to the light radiation apparatus 36. The welding strip 28 can thus be coactivated in one operation.

We claim:

1. In a cigarette packet of a laminated sheeting comprising an outer, thermally bondable layer, wherein a blank encloses the contents of the pack in a tubular manner and end flaps are provided which are joined to each other and project beyond the end sides, said end flaps being folded such that an inner longitudinal end flap bears on the packet contents, two side end flaps being folded on this longitudinal end flap and the second outer longitudinal end flap on the side end flaps and the first inner longitudinal end flaps, the improvement characterized in that the outer longitudinal end flap of the laminated foil comprises on both sides an outer thermally bondable layer which extends over the entire end face and along an edge turned towards the packet edge of the inner longitudinal end flap, a first activated bondable welding strip extending the length of the end face, and said side end flaps folded at their diagonals are joined together along second and third welding strips on a diagonal fold line adjoining the first welding strip.

2. A cigarette packet as claimed in claim 1, characterized in that the bondable welding strips are dark-colored and activated by heat rays.

3. A cigarette packet as claimed in claim 1, wherein non-bondable layers comprise an aluminum foil and/or paper layer of the laminated foil, recessed to form partial perforations in individual regions, while retaining the outer thermally bondable layers, such that in these regions only bondable layers bear upon each other, and that the partial perforations are disposed along at least one of the folding lines of side end flaps.

4. A cigarette packet as claimed in claim 3, characterized in that partial perforations are provided in the region of intersection of the diagonally directed folding lines of the side end flaps.

* * * * *